US006659469B1

(12) United States Patent
Leimer

(10) Patent No.: US 6,659,469 B1
(45) Date of Patent: Dec. 9, 2003

(54) MOLDED RUBBER JACKET WITH FABRIC REINFORCEMENT FOR VALVE STEM SEAL

(75) Inventor: Mark A. Leimer, Fort Wayne, IN (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 10/360,663

(22) Filed: Feb. 6, 2003

Related U.S. Application Data

(62) Division of application No. 09/858,618, filed on May 16, 2001, now Pat. No. 6,527,275.

(51) Int. Cl.[7] ..... F02F 11/00; B32B 31/06

(52) U.S. Cl. ..... 277/502; 277/301; 264/262; 264/266; 264/257

(58) Field of Search ..... 277/500, 502, 277/301; 264/262, 266, 268, 239, 241, 257

(56) References Cited

U.S. PATENT DOCUMENTS

| | | | |
|---|---|---|---|
| 141,052 | A | 7/1873 | Heston |
| 2,157,866 | A | 5/1939 | Robertson et al. |
| 2,157,867 | A | 5/1939 | Robertson et al. |
| 3,326,562 | A | 6/1967 | Deuring |
| 3,333,578 | A | 8/1967 | Muller |
| 3,760,606 | A | 9/1973 | Greczin |
| 3,788,295 | A | 1/1974 | Toth |
| 4,244,589 | A | 1/1981 | St. Laurent, Jr. |
| 4,253,675 | A | 3/1981 | St. Laurent, Jr. |
| 4,781,039 | A | 11/1988 | Ribarev et al. |
| 5,395,469 | A | 3/1995 | Suggs, Jr. et al. |
| 5,704,615 | A | 1/1998 | Wheeler |
| 5,775,284 | A | 7/1998 | Kirchner et al. |

*Primary Examiner*—Chuck Y. Mah
*Assistant Examiner*—Enoch Peavey
(74) *Attorney, Agent, or Firm*—Rader, Fishman & Grauer PLLC

(57) ABSTRACT

An elastomeric valve stem seal component is adapted for installation over a valve guide of an internal combustion engine. The seal component incorporates fabric reinforcement within an annular jacket body of the component. In one preferred form, the fabric is positioned intermediate two elastomeric layers of the seal body; i.e. between an inner layer and an outer layer. One preferred manufacturing method provides extrusion of a tube having a fabric reinforcement layer already provided between inner and outer layers. A cutting die incorporates a push ring adapted to move the component along a staged molding assembly process. A series of threaded core pins are utilized for conveyance of the component in the fabrication process, which includes extruding a rubber tube and cover over a series of threaded core pins, cutting a portion of the rubber tube to a predetermined length, and molding the predetermined length to produce the component.

6 Claims, 3 Drawing Sheets

MOLDED RUBBER JACKET WITH FABRIC REINFORCEMENT FOR VALVE STEM SEAL

CROSS-NOTING TO RELATED APPLICATIONS

This application is a divisional of U.S. patent application Ser. No. 09/858,618, filed May 16, 2001 now U.S. Pat. No. 6,527,275, the entire contents of which are incorporated herein by reference.

BACKGROUND OF THE INVENTION

1. Field of the Invention

The present invention relates to valve stem seal assemblies for use in internal combustion engines, and more particularly to the design and construction of molded elastomeric seal components employed in such seal assemblies.

2. Description of the Related Art

Those skilled in the art will appreciate the manner in which intake and exhaust valves are employed in cylinder heads of internal combustion engines. Such valves, supported for reciprocal motion within valve guides, include integral elongated stems extending away from the engine cylinder heads, the ends of the stems typically interacting with rotating overhead cams for cyclic or repeated opening and closure of the valves against the force of valve return springs during the combustion cycle. In order to permit unobstructed reciprocal movement of the stem in the guide, some mechanical clearance must obviously exist between the valve guide and the moving stem. In fact, a plurality of such valve stems move reciprocally in valve guides, to and from the cylinder head, each within its individual guide. So-called valve stem seal assemblies are used to seal against leakage of oil through a mechanical clearance path between each annular engine valve guide and its associated valve stem.

As is well known, the intake port of a combustion chamber is opened and closed by the reciprocating motion of at least one intake valve, which in turn is driven by the rotary motion of a cam, the latter being affixed to and rotatable with an engine camshaft. The intake valve permits fuel mixed with air to flow into the combustion chamber. In addition, an internal combustion engine has at least one exhaust valve and associated exhaust port for releasing expended combustion gases to the atmosphere. Typically, intake and exhaust valves are of similar construction and both include stems integrally affixed to the valves.

In some engines, a unitary elastomeric valve stem seal component is fitted over or atop each valve guide, wherein the seal component is frictionally mounted directly to the guide. In other cases the seal is encased within or otherwise secured to a rigid, typically metal, seal retainer to form an assembly, as required in some applications to assure proper securement of the seal to the guide. Those skilled in the art will appreciate that pluralities of such elastomeric valve stem seal components are employed in typical engines. In the case of a V-8 engine, a total of at least 16 valve stem seals are employed, one for each intake and one for each exhaust at each cylinder, depending on actual number of valves employed per cylinder in a particular engine.

Traditional elastomeric seal components have been fabricated using techniques that address only the chemical compositions of various elastomeric materials employed. Thus, even in environments wherein tougher elastomeric materials may be required, only the material compositions have been modified to enhance strength of materials as desired. In many cases, this approach has been fraught with significant technical complexity, and has yielded minimal results.

In addition, traditional manufacture of such seals has been only on a unitary batch basis, or via one batch at a time. Thus, although much progress has been achieved in the art of valve stem seal design and construction, cost-effective techniques for enhancement of strength of materials, along with streamlined manufacturing techniques remain areas in need of additional improvement.

SUMMARY OF THE INVENTION

The improved valve stem seal component of the present invention overcomes the traditional compositional limitations of prior art elastomeric seals with respect to enhancement of strength of materials, and also significantly streamlines valve stem seal component manufacturing, both in a cost-effective assembly line process.

The present invention provides an elastomeric seal component adapted for installation directly atop of a valve guide of an internal combustion engine. A plurality of such seal components is contemplated for use in an engine, each component designed for insertion over each engine valve guide of a given engine. Each component is adapted for continuously and sealingly engaging an associated reciprocally movable valve stem. The seal component body incorporates an interior circumferential aperture containing at least one radially inwardly directed, resilient, sealing lip adapted to engage the stem to minimize escape of oil lubricant from the engine along a path between the valve guide and the reciprocally movable valve stem.

The unique seal component incorporates fabric reinforcement within the annular jacket body of the seal body. In one preferred form, the fabric is positioned intermediately between two layers of the seal body; i.e. between an inner layer and an outer layer.

Finally, two manufacturing methods are presented for manufacture of the seal component. A first provides for extrusion of a tube having the fabric reinforcement layer already provided between inner and outer layers. A cutting die incorporates a push ring adapted to move the component along a staged molding assembly process. A series of threaded core pins are utilized for conveyance of the component in the fabrication process from one stage to the next. The preferred method consists of extruding a rubber tube and cover over a series of threaded core pins, the tube including a fabric reinforcement material positioned intermediate the tube layers; cutting a portion of the rubber tube to a predetermined length; molding the predetermined length of the tube to produce an annular valve stem seal component; curing the molded component; and removing the component from the mold.

An alternate method, called a transfer mold approach, provides molding an inner tube over a threaded core pin; applying a spiral knit reinforcement fabric to the exterior of the inner tube; molding a cover to the tube so as to directly overlie the reinforcement fabric to thus form a fabric reinforced valve stem seal; curing the seal component; and then removing the seal component from the core pin.

DESCRIPTION OF THE PREFERRED EMBODIMENT

Figure 1:
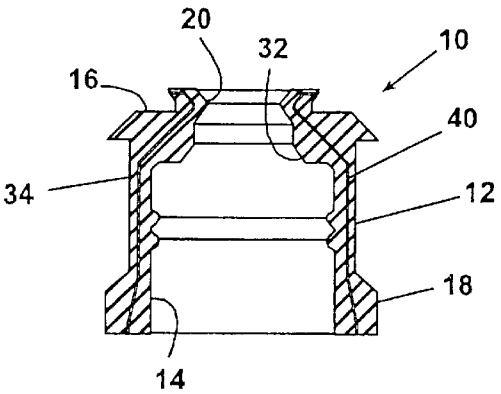
FIG. 1 is a cross-sectional view of one preferred embodiment of the valve stem seal component of the present invention.
Figure 2:
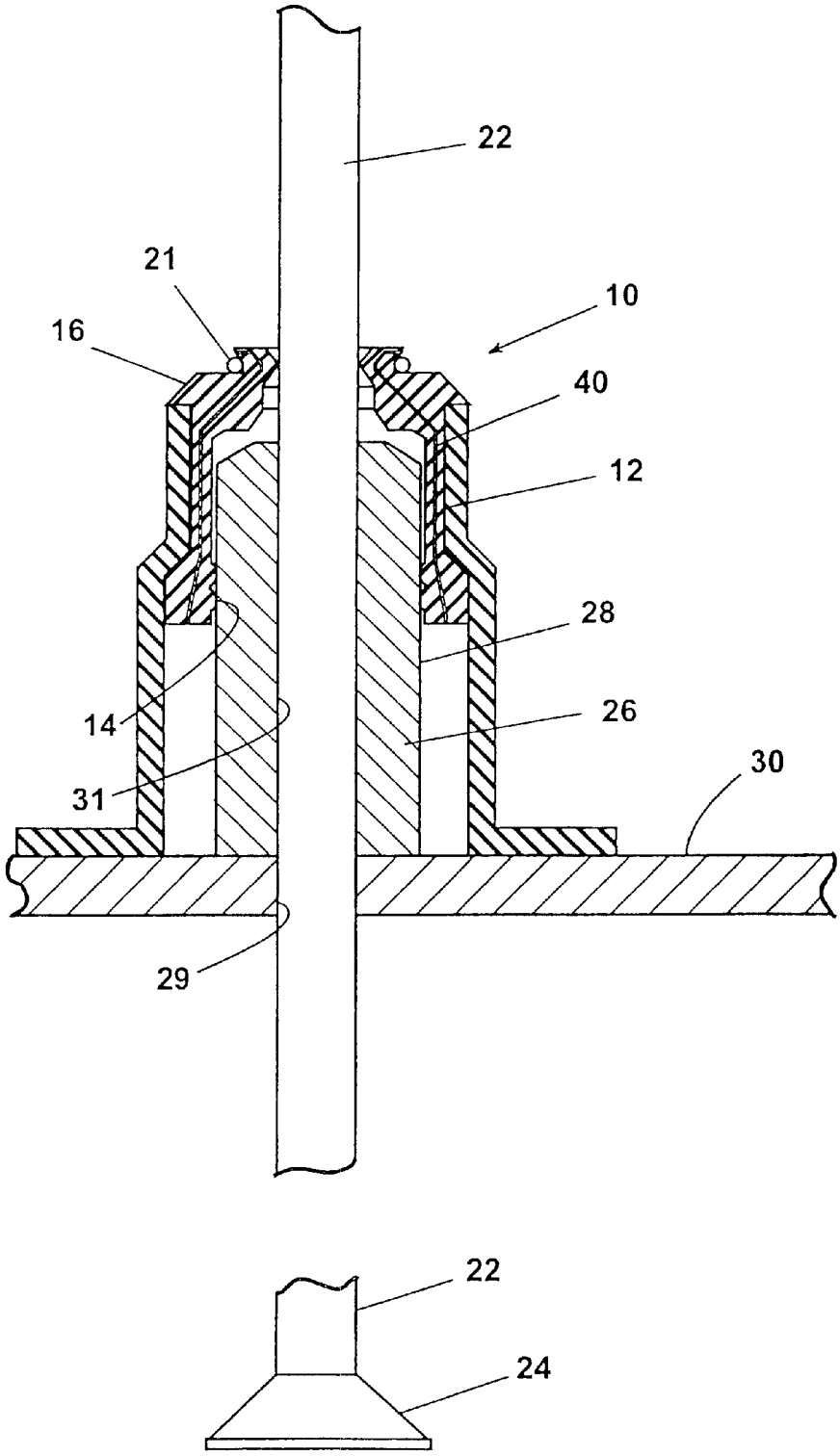
FIG. 2 is a cross-sectional view of the same preferred embodiment of the valve stem seal component, showing same to be installed over a valve guide in an internal combustion engine.

Referring initially to FIGS. 1 and 2, a valve stem seal component 10 is formed of a resilient material, having an exterior annular body surface 12 and an interior circumferentially extending body surface 14. The component 10 includes an upper jacket body portion 16 and a lower jacket body portion 18, the upper body portion containing a circumferentially extending interior sealing lip 20. The lip 20 is adapted to sealingly engage an elongate valve stem 22. The valve stem 22 extends upwardly from a valve 24 (shown broken away from stem 22) adapted to close against a valve seat (not shown) in the top of a combustion chamber (not shown). The stem 22 is supported for reciprocal movement within an annular valve guide 26. The guide 26 is fixedly secured in, and extends longitudinally (or upwardly, as shown) through, an aperture 29 of a cylinder head deck 30.

For sealing engagement of the reciprocally moving valve stem 22, the interior body surface 14 of the seal component 10 is frictionally supported directly to the exterior circumferential surface 28 of the valve guide 26. The circumferentially extending sealing lip 20 is adapted to engage the exterior circumferential surface of the stem 22 for limiting and or otherwise controlling movement of crankcase oil along a mechanical clearance path 31 between the stem 22 and the valve guide 26, for undesirable escape of oil into the combustion chamber, as will be appreciated by those skilled in the art. In this particular embodiment, the seal component 10 is frictionally and circumferentially supported directly on the valve guide 26. However, in other embodiments, depending in part on operating conditions, a seal retainer (not shown) can be employed to secure the elastomeric seal component 10 onto the guide 26. In most such cases, the retainer will have a shape adapted to matingly register with the exterior annular body surface 12 of the seal component 10. Finally, to enhance sealing effectiveness, a garter spring 21 encircles the exterior upper body portion 16, radially outwardly of the sealing lip 20, to impart a radial compression force against the lip 20, and ultimately against the reciprocally moving valve stem 22.

Referring now specifically to FIG. 1, the construction of the seal component 10 of this invention incorporates an inner elastomeric tube 32 and an outer elastomeric cover 34 molded together. Intermediately positioned between tube and cover, however, is a fabric reinforcement 40 for imparting strength, robustness, and enhanced integrity for avoiding tears or other potential deterioration of the seal walls. As such, a skeleton or frame is encapsulated within the elastomeric seal component 10, which may be manufactured via either extrusion or transfer molding processes as described below. In a preferred form, the fabric reinforcement 40 may be applied in a knit form using a nylon or cotton material, preferably arranged in a spiral pattern for enhanced strength. A geometric repetitive pattern such as a diamond-shaped configuration (not shown) is one example of such a preferred design.

Figure 3:
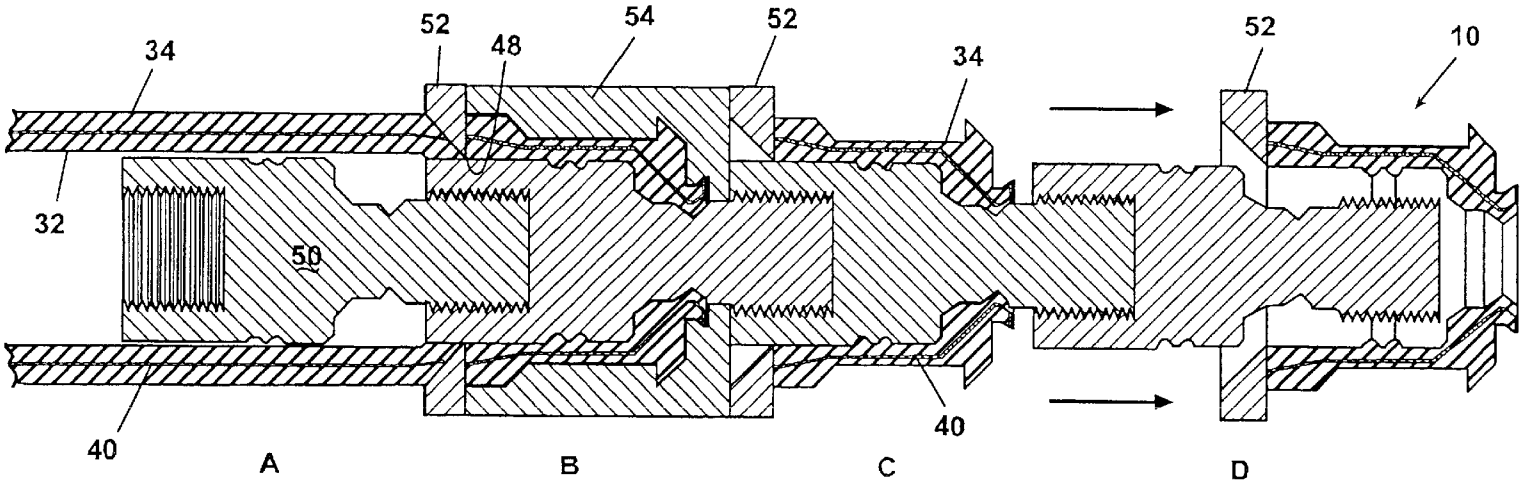
FIG. 3 is a cross-sectional view of an extrusion process employed in the manufacture of the valve stem seal component of the present invention.

Referring now to FIG. 3, a preferred combination method of extruding and molding the seal component 10 is demonstrated in stages represented from left to right as A, B, C, and D. A combination inner elastomeric tube 32 and outer elastomeric cover 34 with the fabric reinforcement 40 already contained therebetween is installed over a threaded core pin 50 as shown at stage A. The threaded core pin 50 is in turn threaded to a longitudinal series of threaded core pins so as to accommodate a continuous process involving stages A through D. At stage B, a predetermined length of the combination tube 32 and elastomeric cover 34 enters a tube mold 54 whereupon a predetermined length is cut by the blade 48 of a cutting die/push ring 52. Within the tube mold 54, the valve stem seal component 10 is shaped via a molding process. Thereafter, the component 10 is cured at stage C. Finally, at stage D, the push ring 52 advances, as indicated by the arrows, to push the completed seal component 10 off of its core pin 50. At this point, the core pin 50 at stage D is unthreaded from trailing core pin 50 at stage C, and is re-threaded at the start of the process at stage A.

Figure 4:
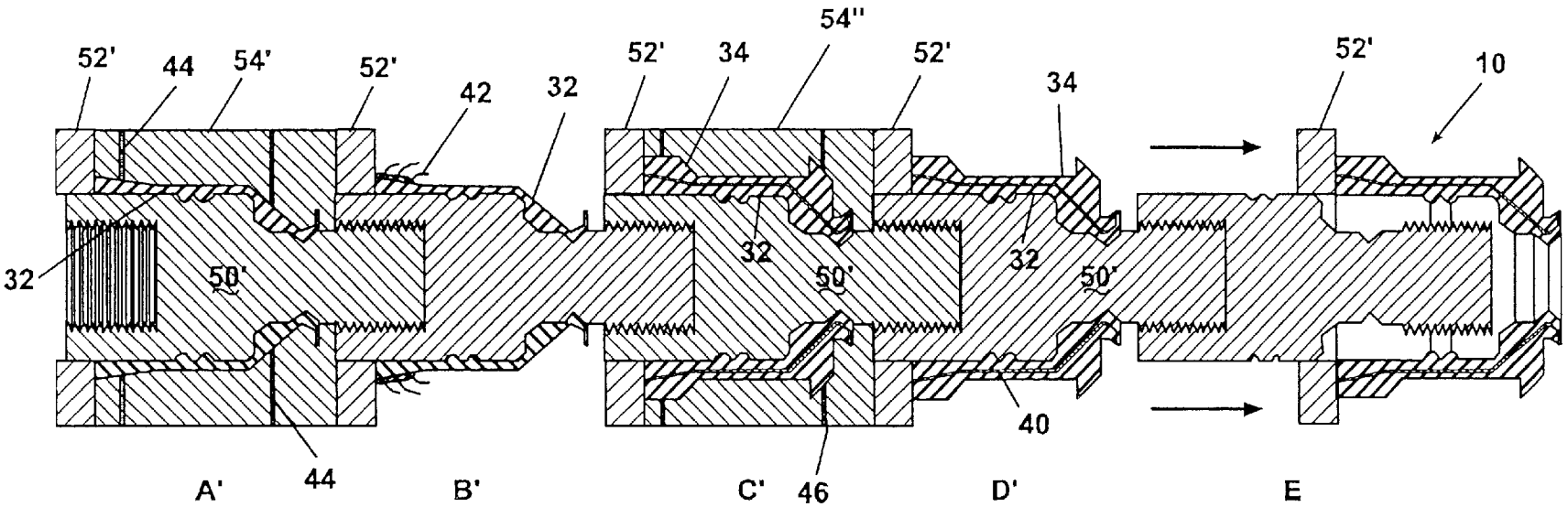
FIG. 4 is a cross-sectional view of an alternate, transfer mold, process for manufacturing the valve stem seal component of the present invention.

Referring now to FIG. 4, an alternate so-called transfer mold process is depicted in stages A', B', C', D', and E. At stage A', elastomeric material is transferred into a tube transfer mold 54' through a set of mold sprues 44 about a first of a series of threaded core pins 50'. At stage A' the inner elastomeric tube 32 is first formed as shown. A push ring 52' thereafter advances the tube 32 to stage B'. At stage B' a spiral knit reinforcement fabric 42 is applied to the tube 32, with for example a needle spiral knitter (not shown). Next the push ring 52' advances the product-in-process to stage C' wherein the outer cover 34 is molded into place within a second tube transfer mold 54", the elastomeric material entering through a second set of sprues 46 as shown. The push ring 52' next advances the product-in-process to stage D' wherein curing of the elastomeric material takes place. Finally, at stage E, the push ring 52' advances, in direction of the arrows, to remove the finished seal component 10 from its threaded core pin 50'.

It is to be understood that the above description is intended to be illustrative, and not limiting. Many embodiments will be apparent to those of skill in the art upon reading the above description. The scope of the invention should be determined, however, not with reference to the above description, but with reference to the appended claims and the full scope of equivalents to which the claims are entitled by law.

What is claimed is:

1. A method of manufacturing an elastomeric annular valve stem seal comprising a jacket body including a cylindrical wall of variable thickness over its cross-section, said wall further including a fabric reinforcement substantially contained within said wall comprising the process steps of:

a) extruding a rubber tube and cover over a mandrel, said tube including a fabric material positioned intermediate said tube and cover;

b) cutting a portion of said rubber tube to a predetermined length;

c) molding said predetermined length of said tube to produce an annular valve stem seal jacket body;

d) curing said molded jacket body, and then e) removing said jacket body from said mold.

2. The method of claim 1 wherein said mandrel comprises a plurality of threaded core pins, and wherein said fabric comprises a knit fabric.

3. The method of claim 2 herein each of said process steps occurs in first through final stages, said method further comprising the removal of a threaded core pin at the final stage of the process and insertion thereof at the first stage of said process.

4. A method of manufacturing an elastomeric annular valve stem seal comprising a jacket body including a cylindrical wall of variable thickness over its cross-section, said wall further including a knit fabric reinforcement substantially contained within said wall comprising the steps of:

a) molding a tube over a threaded core pin;

b) applying a spiral knit reinforcement to the exterior of the tube;

c) molding a cover to the tube over said reinforcement to form a fabric reinforced valve stem seal; and d) removing the resultant valve stem seal from the core pin for curing thereof.

5. The method of claim 4 further comprising removal of the core pin upon said removal from the end of the process and insertion thereof at the beginning of said process.

6. The method of claim 5 wherein said core pins comprise a series of threaded members, and wherein said knit fabric is applied in a spiral pattern.

* * * * *